US006220933B1

(12) United States Patent
Shih et al.

(10) Patent No.: US 6,220,933 B1
(45) Date of Patent: Apr. 24, 2001

(54) HIGH INFEED RATE METHOD FOR GRINDING CERAMIC WORKPIECES WITH SILICON CARBIDE GRINDING WHEELS

(75) Inventors: Albert J. Shih; Thomas M. Yonushonis, both of Columbus, IN (US)

(73) Assignee: Cummins Engine Company, Inc., Columbus, IN (US)

( * ) Notice: Subject to any disclaimer, the term of this patent is extended or adjusted under 35 U.S.C. 154(b) by 0 days.

(21) Appl. No.: 09/356,880

(22) Filed: Jul. 19, 1999

Related U.S. Application Data

(62) Division of application No. 08/940,998, filed on Sep. 30, 1997.

(51) Int. Cl.[7] ..... B24B 1/00
(52) U.S. Cl. ..... 451/28; 451/41
(58) Field of Search ..... 451/41, 28

(56) References Cited

U.S. PATENT DOCUMENTS

| | | | | |
|---|---|---|---|---|
| 2,397,777 | | 4/1946 | Colman . | |
| 3,375,181 | | 3/1968 | Koech . | |
| 3,508,533 | | 4/1970 | Abrams . | |
| 3,718,447 | | 2/1973 | Hibbs, Jr. et al. . | |
| 3,794,334 | | 2/1974 | Prasse et al. . | |
| 3,898,148 | * | 8/1975 | Sam | 204/217 |
| 4,032,286 | | 6/1977 | Kobayashi et al. . | |
| 4,182,082 | | 1/1980 | Meyer . | |
| 4,226,055 | | 10/1980 | Komanduri et al. . | |
| 4,476,656 | | 10/1984 | Bovenkerk . | |
| 5,024,711 | * | 6/1991 | Gasser et al. | 156/153 |
| 5,146,909 | | 9/1992 | Ruark et al. . | |
| 5,203,122 | * | 4/1993 | Campbell | 451/541 |
| 5,209,403 | | 5/1993 | Tarr et al. . | |
| 5,564,966 | | 10/1996 | Nishioka et al. . | |

* cited by examiner

*Primary Examiner*—David A. Scherbel
*Assistant Examiner*—Shantese McDonald
(74) *Attorney, Agent, or Firm*—Nixon Peabody LLP; Charles M. Leedom, Jr.; Thomas W. Cole

(57) ABSTRACT

A method for accurately and economically shaping a zirconia workpiece with a relatively inexpensive silicon carbide grinding wheel is provided. The grinding wheel used in the method preferably utilizes 220 mesh silicon carbide particles bound in a low porosity vitreous matrix. The grinding wheel is then rotated at a sufficient speed to implement a grinding operation, and is engaged against the zirconia workpiece at a diametral feed rate of at least 0.04 mm/sec. The method advantageously removes material from the zirconia workpiece at a high rate of speed with minimal wheel wear, and results in accurate cuts and smooth surface finishes, and also eliminates the need for dressing the wheel prior to the grinding operation.

10 Claims, 6 Drawing Sheets

220L
220N
220P
220S
120L
220S (SUPPLIER B)
220S (SILICON NITRIDE)

HIGH INFEED RATE METHOD FOR GRINDING CERAMIC WORKPIECES WITH SILICON CARBIDE GRINDING WHEELS

This application is a division of Ser. No. 08/940,998, filed Sep. 30, 1997.

BACKGROUND OF THE INVENTION

This invention generally concerns high-efficiency methods of grinding ceramic workpieces, and is specifically concerned with a method for grinding zirconia workpieces with a silicon carbide grinding wheel at a high infeed rate.

Methods for shaping and machining ceramic workpieces with grinding wheels are well known in the prior art. The workpieces may be, for example, the zirconia plungers used in diesel engine fuel injectors. The transition-toughened zirconia used to form such plungers has a Knoop hardness of between about 1,000–1100 kg/mm$^2$. In the past, grinding wheels employing either diamond or CBN (carbon-boron-nitrogen) abrasives have been used having Knoop hardnesses of 7,000 kg/mm$^2$ and 4,800 kg/mm$^2$, respectively. While the relative hardness of diamond and CBN abrasives allows such grinding wheels to effectively shape the softer zirconia blanks into fuel injector plungers, such abrasive materials are very expensive. Less expensive abrasive materials are known which are still considerably harder than transformation-toughened zirconia. For example, silicon carbide in a green state has a Knoop hardness on the order of 2,800 kg/mm$^2$, which is considerably higher than the Knoop hardness of 1,000–1,100 kg/mm$^2$, associated with zirconia. Unfortunately, attempts to use less expensive silicon carbide grinding wheels to machine zirconia and ceramics of like hardnesses have not yet met with any practical success. But before the meaning of the term "practical success" can be understood in this context, some additional background information is necessary.

In order for a grinding operation to be efficient and effective, at least three factors must be present. First, the ratio of the volume of material removed from the workpiece must be substantially higher than the volume of material worn away from the grinding wheel as a result of the grinding operation. This factor is known as the G-ratio. It is a parameter used extensively to characterize the effectiveness of a grinding wheel for a specific work-material under a given setup. A high G-ratio means the grinding wheel will have less wear to remove a specific volume of work-material and better control of the cut tolerances. Due to the uneven wear in the grinding wheel, the G-ratio is frequently calculated on the basis of the average diametral wheel wear, $\delta_{avg}$, which may be expressed as follows:

$$\delta_{avg} = \left(\frac{d_5 + d_6}{2}\right) - \left(\frac{d_3 + d_4}{2}\right)$$

where $d_1$ and $d_2$ are the diameters of the front and back ends of the ground workpiece, and $d_3$ and $d_6$ are the diameters of the grinding wheel across different sections, as measured in a plastic molding made of the worn wheel.

This factor may then be used to calculate a G-ratio designed as $G_{avg}$ as follows:

$$G_{avg} = \frac{N\left[D^2 - \left(\frac{d_1 + d_2}{2}\right)^2\right]}{D_w^2 - [D_2 - \delta_{avg}]^2}$$

where

N is the number of ceramic parts ground,

D is the initial diameter of the ceramic blank, and $D_w$ is the diameter of the grinding wheel.

A G-ratio of 1 would indicate that the volume of material removed from the grinding wheel as a result of wheel wear was the same as the volume of material removed from the workpiece. Such a low ratio is generally unacceptable, since it indicates that the grinding wheel would have to be retrued after only a few workpieces had been ground. Such frequent grinding wheel reshaping is not only expensive, but also time consuming. Generally speaking, the G-ratio must be on the order of about 5 or higher for an acceptable degree of economy to be realized in production grinding.

A second required factor is that the grinding operation must accurately machine the workpiece to within the required tolerances. For example, if the purpose of the grinding operation is to machine a piston head around a blank ceramic workpiece, then the circular cross section of the piston head must conform to a high degree of roundness, or the piston head will either not fit into its cylinder bore during assembly, or will fail to generate adequate compression within the bore. This particular factor may be expressed as "roundness", and is expressed in terms of the maximum linear distance variation between measured roundness and true roundness. For example, a roundness of 0.01 mm would indicate a maximum variation from true roundness of 0.01 mm along all diameters.

The third required factor is surface finish, which is an indication of the roughness of the resulting ground surface on the ceramic workpiece. In the U.S., surface finish is usually expressed as the arithmetic average of variations in the surface from planarity, and is designated as Ra.

There are other factors that can be considered when evaluating the efficiency and effectiveness of a grinding operation, but G-ratio, roundness and surface finish are certainly among the most important in a manufacturing operation as they bear directly on wheel wear and the resulting quality of the machining operation.

Previous attempts to grind zirconia workpieces with relatively inexpensive silicon carbide grinding wheels have failed to produce high-tolerance cuts within acceptable G-ratios. The G-ratios associated with such attempts almost never been higher than 2.0, and are more typically 1.0 or less. Worse yet, the lack of accuracy of the cuts made in such prior art grinding operations has precluded the use of such low cost grinding wheels where tight tolerances are required. The frequent wheel retruing and replacement associated with such low G-ratios, in combination with the inaccurate cuts made by such wheels has resulted in the near exclusive use of diamond or CBN-type grinding wheels for the precision machining of zirconia ceramic components, despite their high cost.

Clearly, there is a need for a method of producing high-tolerance cuts in ceramic materials such as transformation-toughened zirconia and silicon nitride without the use of expensive diamond or CBN grinding wheels. Ideally, such a method would employ silicon carbide grinding wheels which could perform a high-tolerance cut in ceramic workpiece with high G-ratio and superior surface finish.

SUMMARY OF THE INVENTION

Generally speaking, the invention is a method for grinding a ceramic workpiece by means of a grinding wheel having abrasive particles of silicon carbide embedded in a matrix of hard, strong, and low porosity bonding material that includes the steps of rotating the grinding wheel, and engaging the peripheral work face of the wheel against the ceramic workpiece at a high diametral infeed rate of at least 0.04 mm/sec. The inventors have surprisingly found that the use of such a high infeed rate not only raises the G-ratio an order of magnitude, but also results in a highly accurate cutting action capable of dimensioning zirconia and silicon nitride workpieces to tight tolerances and with superior surface finishes. Serendipitiously, the use of a high diametral infeed rate also eliminates the need for frequent wheel truing operations that are normally associated with such grinding operations, thus compounding the economies and advantages associated with the method. In the preferred method, the grinding wheel comprises silicon carbide particles having a U.S. ANSI mesh between 120 and 220 that are bound in a vitreous matrix having low porosity (i.e. less than 36%).

The grinding engagement step of the invention may be executed at an infeed rate that ranges from below the aforementioned value of 0.04 mm/sec up to and including 0.170 mm/sec for workpieces formed from zirconia However, for a harder workpiece formed from silicon nitrides, the infeed rate should range from between about 0.01 mm/sec to 0.04 mm/sec. Even higher infeed rates may be possible in certain instances for zirconia assuming that the grinding machine and workpiece can withstand the grinding forces associated with such higher rates. The grinding wheels should be rotated so that the peripheral work surface thereof attains a peripheral speed of at least 20 m/sec, and more preferably over 35 m/sec.

While not conclusively determined by the inventors, it is believed that the high G-ratio, precision cutting action, and elimination of the need for frequent truing and dressing the wheel are all caused by the action of the grinding debris in uniformly eroding the vitreous bonding material that surrounds the individual abrasive grains of silicon carbide. The grinding operation immediately creates zirconia particles having a Knoop hardness of between 1,000–1,100 kg/mm$^2$ that average about3 to 4 microns in size. These debris particles are substantially harder than the vitreous bond surrounding the silicon carbide particles (which have a Knoop hardness of approximately 600 kg/mm$^2$), and it is believed that they act to erode the surrounding bonding material to expose the sharp edges of the silicon carbide particles as soon as an undressed wheel comes into contact with a zirconia workpiece. Thus exposed silicon carbide particles proceed to efficiently and precisely cut the zirconia workpiece as long as the forces necessary for the aforementioned high infeed rate are maintained.

DETAILED DESCRIPTION OF THE PREFERRED EMBODIMENTS

Figure 1A:
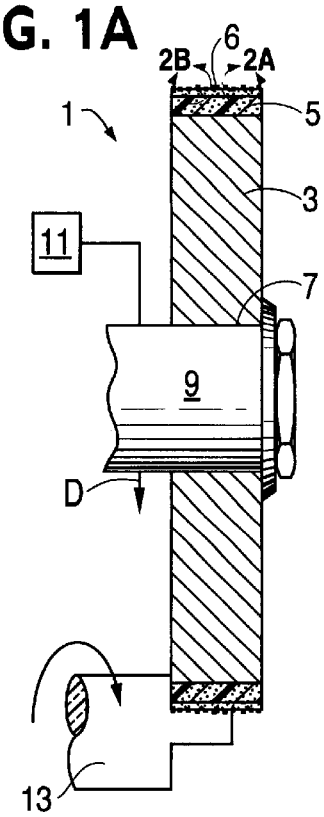
FIG. 1A is a front cross-sectional view of a grinding wheel implementing the method of the invention on a ceramic workpiece.
Figure 1B:
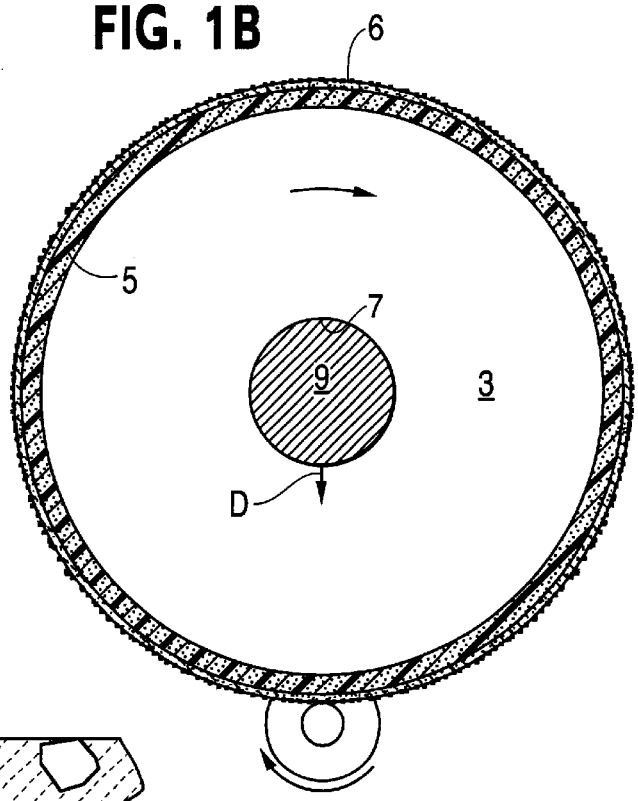
FIG. 1B is a side cross-sectional view of the grinding wheel of FIG. 1A.

With reference now to FIGS. 1A and 1B, the method of the invention is preferably implemented by a silicon carbide grinding wheel 1. Such a wheel 1 may have a metal support wheel 3 circumscribed by an annular, abrasive layer 5 that terminates, around its periphery, in a work surface 6. Alternatively, the grinding wheel 1 may be formed completely from the annular abrasive layer 5 without the metal support wheel 3. In either case, such a wheel 1 preferably includes a circular opening 7 concentrically aligned with its axis of rotation for receiving and securing a drive shaft 9. The drive shaft 9 is in turn connected to a grinding wheel manipulator 11 (indicated in schematic). The manipulator 11 functions to move the grinding wheel 1 along its diameter in a direction indicated as "D" in FIGS. 1A and 1B. As will be discussed in more detail hereinafter, a critical aspect of the invention is the rate at which the manipulator 11 moves the grinding wheel 1 the distance D toward a ceramic workpiece 13. The rate of such movement along D is defined herein as the infeed rate of the wheel 1 against a workpiece 13. The annular abrasive layer 5 of the grinding wheel 1 is preferably formed from 220 ANSI mesh particles 15 of silicon carbide bound in a vitreous matrix 17. Such silicon carbide particles have a Knoop hardness of about 2,800 kg/mm$^2$ which is harder than zirconia. While coarser grain sizes of up to 120 mesh may be used, the relatively fine 220 mesh size is preferred because it is less friable and can make more accurate cuts in a ceramic workpiece 13 with virtually no compromise in either cutting rate or wheel wear.

As will be better appreciated shortly, the vitreous matrix 17 used in the grinding wheel 1 should be the least porous matrix material that is commercially available. There are four different grades of grinding wheel porosity that are commercially available, which in order of descending porosity are designated as L, N, P, and S. A low porosity, "S" grade grinding wheel 1 is preferred, although many of the advantages of the invention may be realized by the use of a wheel 1 with a medium porosity of P. Regardless of industry hardness-labels, it is believed that the invention is best implemented by a grinding wheel 1 whose abrasive layer 5 is a mixture of fine grain particles 15 of silicon carbide in a low porosity vitreous matrix 17 which may be porcelain, but which also may be made of other grain-binding materials such as metals or resins. In the context of this application, the term "low porosity" means less than about 36% porosity, and more preferably less than 31% porosity. The term "medium porosity" means about a 36% porosity. A typical grinding wheel suitable for implementing the invention would have an abrasive layer consisting of about 36% silicon carbide particles by volume, and 33% vitreous binding material by volume with the remainder being air spaces resulting from a 33% porosity.

In the first step of the method of the invention, the drive shaft 9 is actuated in order to bring the peripheral work surface 6 of the annular abrasive layer 5 to a linear speed effective to implement a grinding operation. For the purposes of the invention, such a linear speed is on the order of 48 m/sec, although speeds as low as 20 m/sec may also be used. For a 16 inch (406 mm) diameter wheel, such a linear speed is attained at 2,245 rpms.

In the next step of the method, the grinding wheel 1 is moved in the diametral direction D at a rapid rate of, for example, 0.04 mm/sec toward a ceramic workpiece 13, which may either be formed from transformation-toughened zirconia or silicon nitride.

Figure 3:
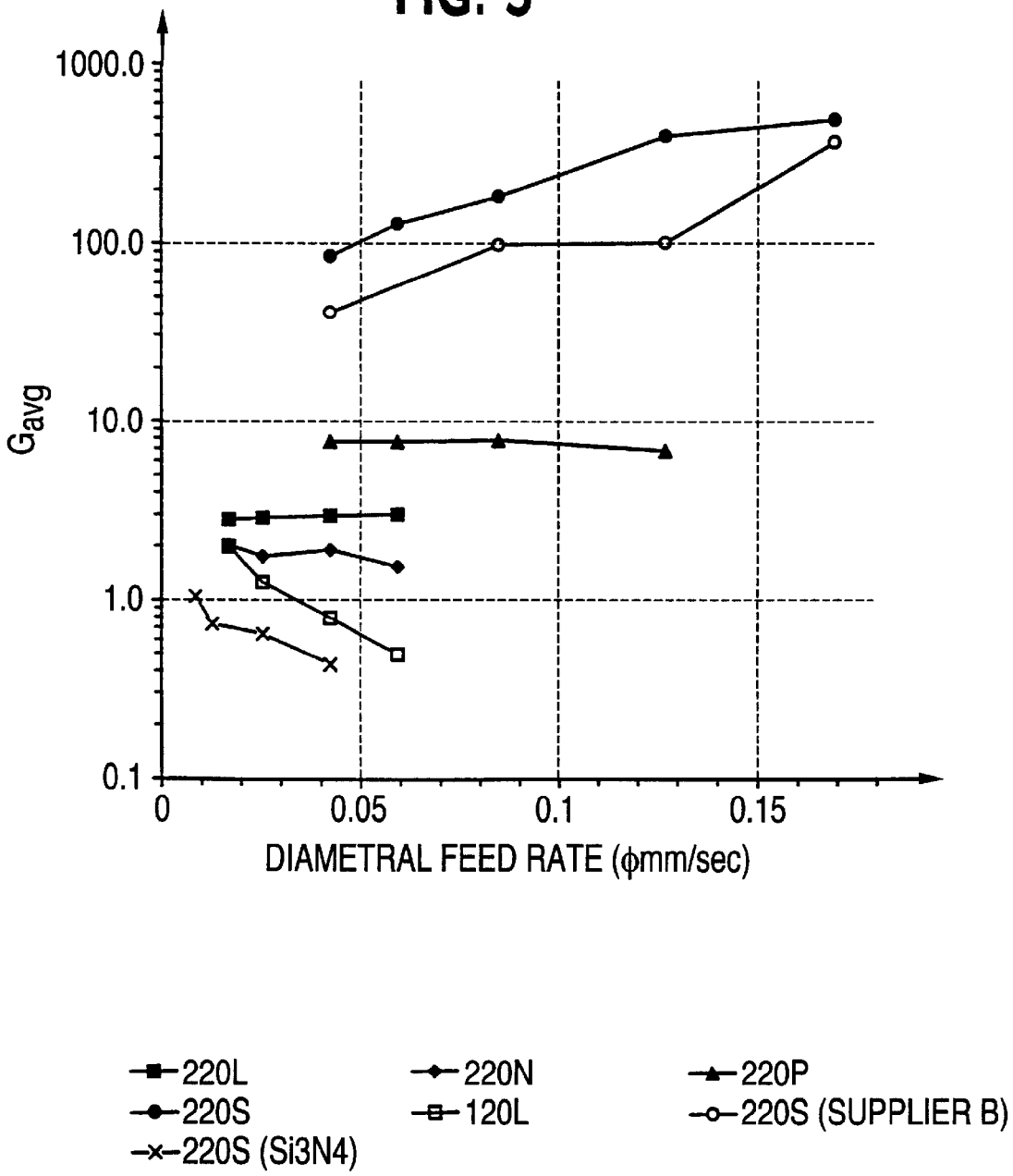
FIG. 3 is a graph illustrating the relationship between the average G-ratio of the grinding wheel and the diametral feed rate of the wheel into a zirconia workpiece for silicon carbide wheels of different porosity levels.
Figure 4:
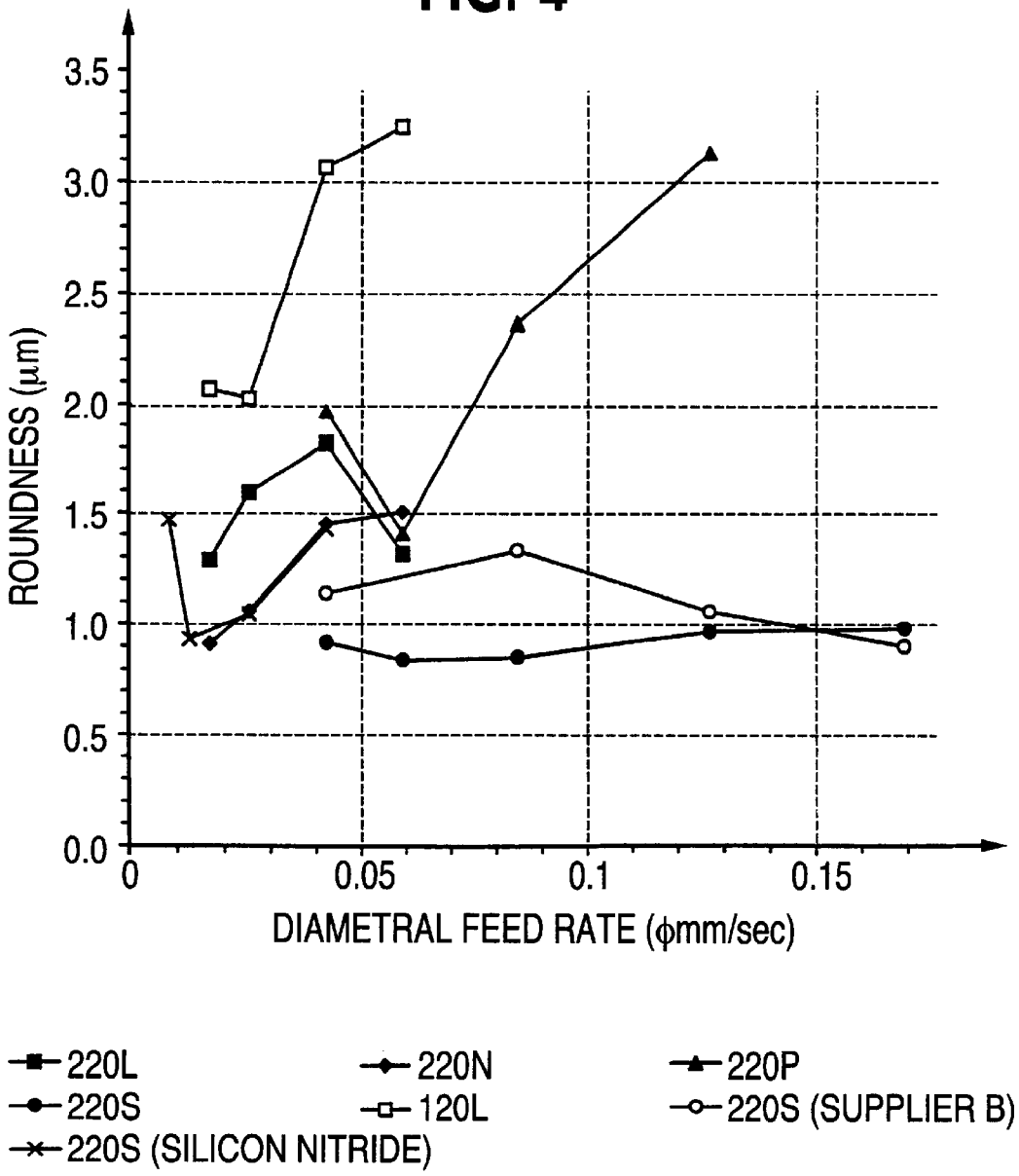
FIG. 4 is a graph illustrating the relationship between the accuracy of a round cut made by a grinding wheel and its diametral feed rate for grinding wheels having different porosity levels.
Figure 5A:
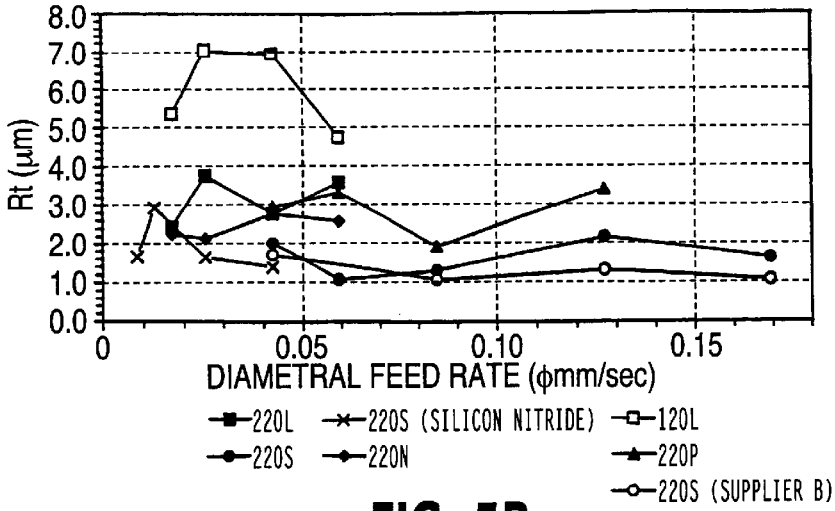
FIGS. 5A, 5B, and 5C each illustrate the relationship between the resulting surface finish of a ceramic workpiece and the diametral feed rate of the grinding wheel for grinding wheels of different porosity levels.
Figure 5B:
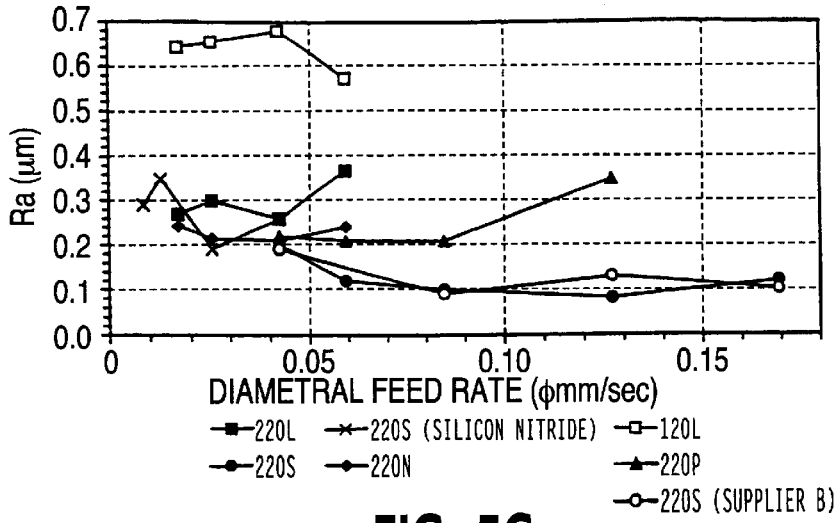
Figure 5C:
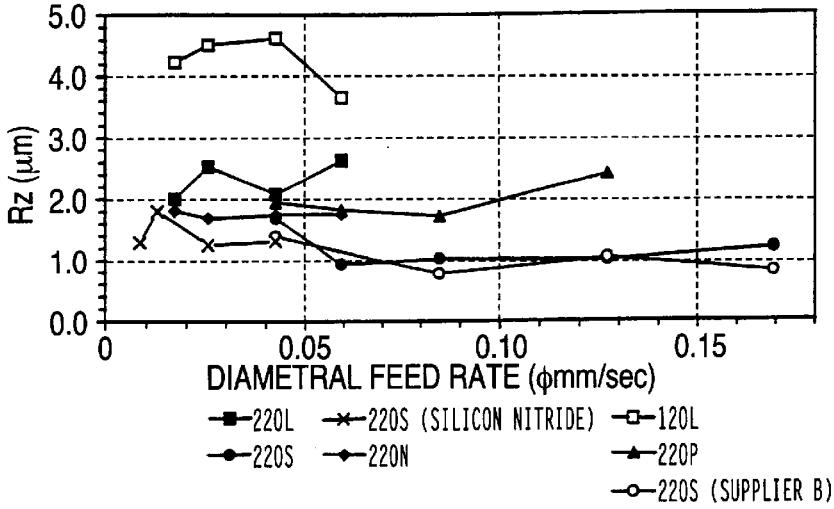

When the workpiece is formed from zirconia, the diametral feed rate may vary from between about 0.04 mm/sec to about 0.170 mm/sec. The resulting advantages in G-ratio, accuracy of cut, and surface finish are illustrated in the graphs in FIGS. 3, 4, and 5A–5C, respectively. In FIG. 3, such a relatively rapid diametral feed rate increases the G-ratio from about 8.0 in the case of a wheel having a medium porosity of P, and to at least 40.0 when the wheel has a low porosity of S. The accuracy of the resulting cut, which is expressed in terms of roundness in FIG. 4, is also substantially increased particularly when a wheel having a low porosity of S is used. Note how the roundness of the resulting cut varies only by approximately 1.0 $\mu$m when silicon carbide wheels having an abrasive layer of low porosity S are used. By contrast, silicon carbide wheels having high porosity ratings of L or N (corresponding to porosity volumes of over 36%) can be off-round by as much as 3.2 $\mu$m at feed rates falling within the aforementioned preferred range. Finally, as is indicated in FIGS. 5A–5C, the resulting surface finish is also superior (i.e., less rough) at such rapid diametral feed rates for silicon carbide wheels with lower porosities of S in particular. Note for example in FIG. 5A how the arithmetic average Ra of surface deviations varying from planarity are only 0.10 $\mu$m for wheels with the lowest porosity S as opposed to 0.70 $\mu$m when wheels of higher porosity L are used.

The graphs in FIGS. 3, 4, 5A–5B also indicate that some of the advantages of the invention may be realized on harder ceramic materials such as silicon nitride. While FIG. 3 indicates that the G-ratio does not improve between a diametral feed rate of 0.01 mm/sec and 0.04 mm/sec, FIG. 4 indicates that the resulting roundness of the cut does improve to a value of about 0.9 $\mu$m for a diametral feed rates of between about 0.010 and 0.025 mm/sec. Additionally, FIGS. 5A–5C indicate that the resulting surface finish is comparable to the best surface finishes accomplished with low porosity silicon carbide wheels on zirconia workpieces at diametral feed rates of between about 0.025 mm/sec and 0.04 mm/sec. Hence most of the advantages realized with respect to zirconia workpieces are also realized with silicon nitride workpieces.

Figure 2A:
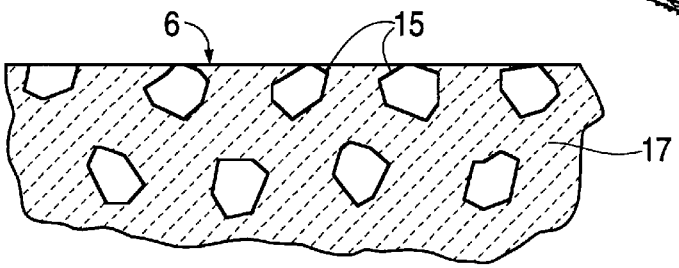
FIG. 2A is an enlargement of the circled section of the peripheral work surface of the wheel of FIG. 1A labeled "2A"
Figure 2B:
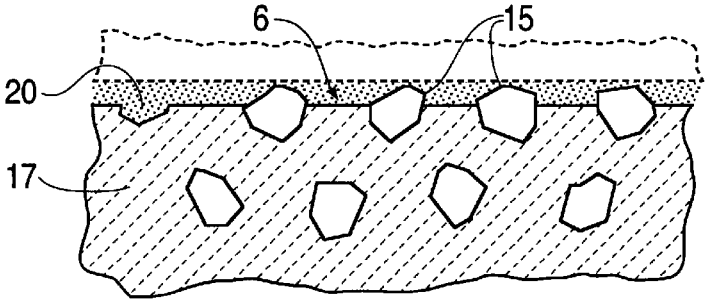
FIG. 2B is an enlargement of the circled portion of the peripheral work surface of the grinding wheel of FIG. 1A labeled "2B"
Figure 6:
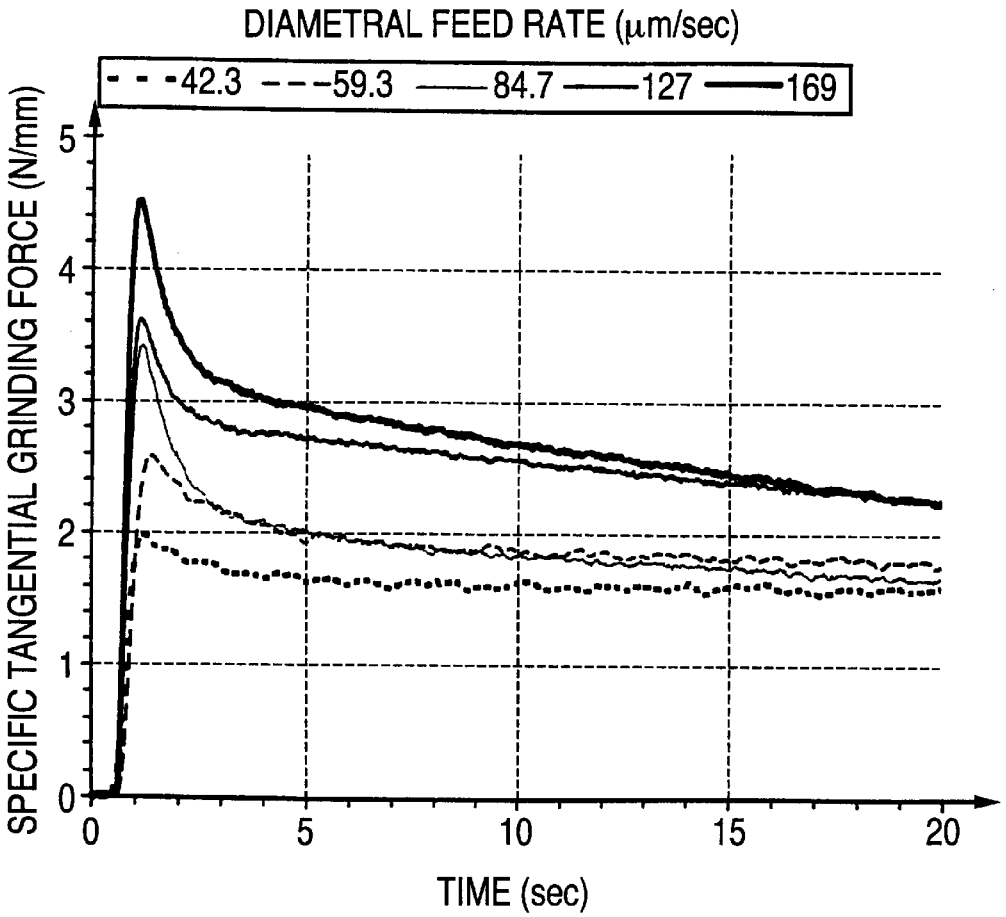
FIG. 6 illustrates the tangential grinding force experienced by the peripheral work surface of the grinding wheel over time for different diametral feed rates of the wheel.
Figure 7:
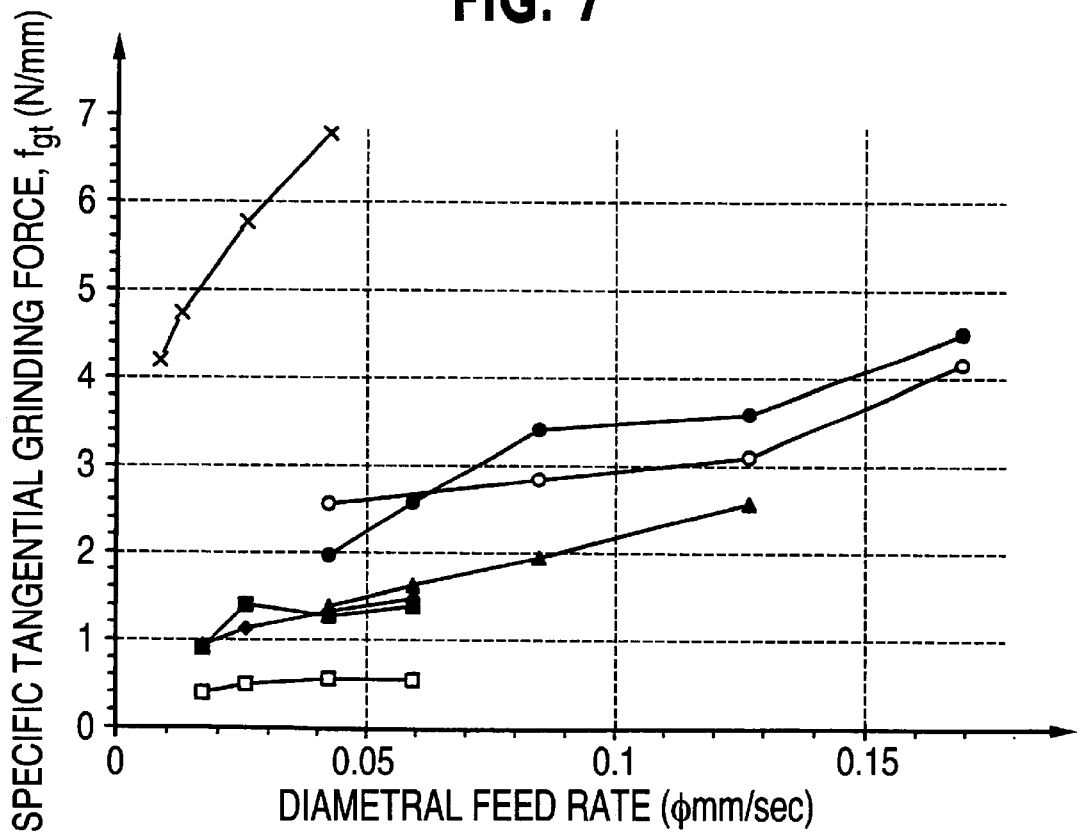
FIG. 7 illustrates the relationship between the tangential grinding force experienced by the peripheral work surface of a grinding wheel versus its diametral feed rate for grinding wheels of different porosity levels.

The advantages of the invention are believed to result from a phenomenon which the inventors have named "grinding debris assisted dressing" or GDAD. This phenomenon may best be understood with respect to FIGS. 2B and 6. FIG. 6 indicates that, when an undressed silicon carbide grinding wheel utilizing 220 mesh size particles of silicon carbide secured in a matrix of low porosity vitreous binder is engaged against a zirconia workpiece, the specific tangential grinding forces maximize within the first second or two of the grind time, the maximum being at its greatest when the diametral feed rates are the highest. This grinding force tapers off quickly after the first two seconds after the grinding operation commences, as is seen in FIG. 6. FIG. 7 corroborates the results indicated in FIG. 6. The applicants believe that the previously mentioned phenomena of GDAD is responsible not only for the rapid tapering off of tangential grinding forces on the work surface of the grinding wheel, but also for the favorable G-ratio, roundness, surface finish and elimination of the need for a wheel dressing step associated with the method of the invention. As is best seen in FIG. 2B, the applicants believe that when an undressed grinding wheel (as shown in FIG. 2A) initially engages a workpiece 13 made of zirconia or other ceramic, that fine, micron-sized particles 20 of zirconia are immediately created. These particles 20 have a Knoop hardness between 1,000 and 1,100, whereas the vitreous agent 17 that actually binds the silicon carbide grains 15 only has a Knoop hardness of about 600. Hence the particles 20 of grinding debris grinds away the portions of the porcelain matrix 17 surrounding the silicon carbide grains 15, thereby exposing the sharp edges of the grains 15. As soon as this happens (which the graph in FIG. 6 indicates occurs in only about 3 seconds), the silicon carbide grains 15 effectively and accurately cut the workpiece 13. Applicants submit that the phenomenon of GDAD, and all the advantages occurring therefrom have gone unnoticed in the prior art due to the substantially slower grinding wheel feed rates used in prior ceramic grinding operations. It is only when a grinding wheel of low or at least medium porosity is used at a high diametral feed rate of at least 0.04 mm/sec (in the case of zirconia) that the advantages of the invention are realized.

While this invention has been described with respect to a specific embodiment, various additions, modifications, and variations of this embodiment would become evident to persons of ordinary skill in the art. All such variations, modifications, and additions are intended to be encompassed within the scope of this invention, which is limited only by the claims appended hereto.

What is claimed:

1. A method for grinding a workpiece formed from one of the group consisting of zirconia, silicon nitride and other ceramics having Knoop hardness of 1000–1,100 kg/mm$^2$, including the steps of forming a grinding wheel with a peripheral work surface including abrasive particles of Knoop hardness on the order of 2,800 kg/mm$^2$ embedded in a matrix of bonding material of medium (P) to low (S) porosity having a Knoop hardness of 600 Kg/mm$^2$ or less;

rotating the grinding wheel at an angular rate sufficient to cause the peripheral work surface to obtain a speed of at least 20 meters/second; and advancing the peripheral work surface of the grinding wheel into grinding engagement with the workpiece at an in-feed rate of at least 0.01 mm/second to form workpiece particles to cause erosion of bonding material to expose the cutting portion of the embedded grinding particles.

2. The method for grinding a ceramic workpiece as defined in claim 1, wherein said abrasive particles are silicon carbide.

3. The method for grinding a ceramic workpiece as defined in claim 1, wherein said bonding material is a selected one of the group consisting of porcelain, metal, and resin.

4. The method for grinding a ceramic workpiece as defined in claim 2, wherein said silicon carbide abrasive particles are finer than 80 mesh.

5. The method for grinding a ceramic workpiece as defined in claim 4, wherein said silicon carbide abrasive particles are between 120 and 220 mesh.

6. The method for grinding a ceramic workpiece as defined in claim 1, wherein said grinding wheel is rotated such that said peripheral work surface attains a peripheral speed of at least 35 meters/second.

7. The method for grinding a ceramic workpiece as defined in claim 6, wherein said grinding wheel is rotated such that said peripheral work surface attains a peripheral speed of no more than 48 meters/second.

8. The method for grinding a ceramic workpiece as defined in claim 1, wherein the peripheral surface of the grinding wheel is advanced into grinding engagement with the workpiece at an infeed rate of between about 0.04 and 0.170 mm/second.

9. The method for grinding a ceramic workpiece as defined in claim 1, wherein said matrix of bonding material has a Knoop hardness of at least 500 $kg/mm^2$.

10. The method for grinding a ceramic workpiece as defined in claim 1, wherein said porcelain matrix is characterized by a porosity of 36% or lower.

* * * * *